US006265685B1

(12) United States Patent
Faure et al.

(10) Patent No.: US 6,265,685 B1
(45) Date of Patent: Jul. 24, 2001

(54) SWITCHGEAR APPARATUS CONTACT ASSEMBLY INCLUDING SLOT AND FERROMAGNETIC INSERT FOR ENHANCING ARC EXTINGUISHING CHARACTERISTICS

(75) Inventors: Michel Faure, Saint-Paul de Varces; François Sirolli, Vaulnaveys le Haut; Serge Terpend, Grenoble, all of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/453,033

(22) Filed: Dec. 2, 1999

(30) Foreign Application Priority Data

Dec. 30, 1998 (FR) ..... 98 16783

(51) Int. Cl.[7] ..... H01H 33/04
(52) U.S. Cl. ..... 218/149; 200/15; 218/30
(58) Field of Search ..... 218/30–32, 146, 218/149–151; 200/11 B, 11 C, 15, 254, 17 R; 335/16, 147, 201, 202

(56) References Cited

U.S. PATENT DOCUMENTS 3,564,176 * 2/1971 Fechant ..... 218/149
4,219,790 * 8/1980 Batteux et al. ..... 335/16
4,395,606 * 7/1983 Zaffrann et al. ..... 218/149
4,689,588 * 8/1987 Murata et al. ..... 335/201
4,962,406 * 10/1990 Walker et al. ..... 218/26 X
5,029,301 * 7/1991 Nebon et al. ..... 218/146 X
5,343,174 8/1994 Turner et al. ..... 335/172
5,493,091 * 2/1996 Devautour et al. ..... 218/30
5,886,311 * 3/1999 Morel et al. ..... 200/17 R

FOREIGN PATENT DOCUMENTS 794500 2/1936 (FR) .
1158351 7/1969 (GB) .

* cited by examiner

*Primary Examiner*—J. R. Scott
(74) *Attorney, Agent, or Firm*—Parkhurst & Wendel, LLP

(57) ABSTRACT

A switch comprises a long, slender stationary contact means and a movable contact means moving between an open position and a closed position. The contact zone of the contact means is separated from the electrical connection zone by a slot which opens out on the side where the movable contact means are situated in the open position. The depth of the slot is sufficient so that, when opening takes place, the current lines passing through the contact means are curved and run approximately parallel to the flank of the slot. This arrangement prevents the foot of the electrical arc from being directed towards the free end of the contact means, away from the arc extinguishing chamber.

10 Claims, 6 Drawing Sheets

SWITCHGEAR APPARATUS CONTACT ASSEMBLY INCLUDING SLOT AND FERROMAGNETIC INSERT FOR ENHANCING ARC EXTINGUISHING CHARACTERISTICS

BACKGROUND OF THE INVENTION

The invention relates to an electrical switch gear apparatus, in particular a switch, equipped with at least one pair of separable contact means comprising a first long, slender contact means defining a longitudinal axis and a first and a second ends and having a contact zone on the same side as its first end and an electrical connection zone on the same side as its second end, and a second contact means having a contact zone, the pair of contact means being able to take a closed position in which the two contact means are in contact with one another via their respective contact zones, and an open position in which the two contact means are separated from one another, the opening movement being such that when separation of the two contact means takes place, the speed of the contact zone of the second contact means with respect to the first contact means has a predominant component following an axis perpendicular to the longitudinal axis of the first contact means.

A conventional apparatus of this type is represented for example purposes in FIG. 1. A pole 10 of this apparatus comprises a movable contact means 12, a stationary contact means 14 and an arc extinguishing chamber 16 with separators 18. The stationary contact means 14 comprise a contact zone 20 and a connection zone 22.

Likewise, the movable contact means 12 comprise a contact zone 24 and a connection zone 26. The two means 12, 14 are long and slender and placed in the extension of one another so that in the closed position the current lines 28 flowing between the two connection zones are appreciably loop-free. The movement of the movable contact means when opening takes place follows a direction 30 appreciably perpendicular to the direction of the current lines before opening, so that the electrical arc 32 which arises between the contact zones 20, 24 at the level of the last contact points A, B tends to flee towards the ends of the two contact means, at A' and B', according to the directions 34, 36. In particular, the foot of the arc is directed towards A' in the direction 34 opposite to the arc extinguishing chamber 16. This movement is not favorable to entry of the arc into the chamber. In conventional switch gear, the ionization generated by the arc at the beginning of opening is sufficient for a new arc breakdown to take place according to a line of smaller distance between the two contacts. The geometry of the pole is such that this line is situated close to the chamber and passes via the free end B' of the movable contact means 12, so that the new arc extends in the latter, whereas the first arc is extinguished.

This operating mode is satisfactory when the required performances are low, with overload currents lower for example than 6 $I_n$, $I_n$ being the nominal current. It is no is longer suitable when higher performances are sought for, for example with overload currents reaching 8 $I_n$, or when closing and opening cycles on overload are required. The breaking time with such a device is in fact long, and the stagnation of the arc at the end of the contact means causes excessive erosion of the contact zones when the overload currents are high.

It is moreover known that it is possible to direct the arc to the chamber by adopting a stationary contact means having a U shape. However, such a configuration, commonly used for circuit breakers, results in large dimensions.

SUMMARY OF THE INVENTION

The object of the invention is therefore firstly to overcome the shortcomings of the state of the technique without notably increasing the dimensions, and at low cost. In particular its object is to adapt a switch gear apparatus, in particular a switch, so as to limit the movement of the foot of the electrical arc towards the end of one of the contact means.

According to the invention, these objects are achieved by means of an electrical switch gear apparatus, in particular an electrical switch, equipped with at least one pair of separable contact means comprising a first long, slender contact means defining a longitudinal axis and a first and second ends, and having a contact zone on the same side as its first end and an electrical connection zone on the same side as its second end, and a second contact means having a contact zone, the pair of contact means being able to take a closed position in which the two contact means are in contact with one another via their respective contact zones, and an open position in which the two contact means are separated from one another, the opening movement being such that when separation of the two contact means takes place, the speed of the contact zone of the second contact means with respect to the first contact means has a predominant component according to an axis perpendicular to the longitudinal axis of the first contact means, characterized in that the first contact means comprises a slot arranged between its contact zone and its connection zone, close to its contact zone, and opening out on the same side as the first contact means facing the contact zone of the second contact means in the open position.

When the contact means are in the closed position, the current lines are propagated in the material of the first contact means approximately according to the longitudinal direction thereof. When opening takes place, the effective contact surfaces between the two contact means tend to move in the opening direction, and the current lines are forced to run round the slot and to follow a direction approximately parallel to the flank of the slot situated on the side where the contact zone is located. At the moment when separation of the contact means takes place, the curved current lines in the first contact means are relatively stable so that the foot of the arc does not tend to flee towards the free end of the contact means. Due to the movement of the head of the arc towards the end of the second contact means, which takes place in the same way as in the previously described state of the technique, the arc moves globally away from the free end of the first contact means.

The slot opens out on the same side as the first contact means where the contact zone of the second contact means is situated in the open position. The depth of the slot must be sufficiently large for the curving of the field lines to be significant. Furthermore, it must not be too large as the residual material thickness must be sufficient not to cause destructive overheating when short-circuit currents flow in the contact means. The depth of the slot is preferably comprised between ⅓ and ⅔ of the total thickness of the first contact means, measured along said axis perpendicular to the longitudinal axis and in which the opening movement has a predominant component. In practice, good results have been obtained with a depth of about a half of the total thickness of the first contact means.

The flanks of the slot may be parallel or tapered, and the mid-line bisecting the slot may be more or less recumbent with respect to the longitudinal axis of the first contact means. In particular, the slot can extend in the depth of the contact means in a direction forming a small angle, comprised between −45° and +45°, with the axis perpendicular to the longitudinal axis of the first contact means.

The width of the slot, i.e. the distance separating the edges of the slot, must be sufficient to prevent a drop of molten metal from partially obstructing the slot and forming a bridge. It is therefore advantageous to arrange for the slot to have a width larger than 1 mm.

According to one embodiment, the slot has a width such that an electrical arc extending between the contact zones when the contact means are in the open position is able to pass from one edge of the slot to the other. This implies a maximum width to be determined according to the performances of the apparatus.

According to one embodiment, the slot is extended, inside the first contact means, by a cavity extending appreciably along the longitudinal axis of the first contact means.

According to one embodiment, it comprises a ferromagnetic earth arranged close to the slot and designed to foster passage of an electrical arc extending between the contact zones, from the edge of the slot situated on the side where the contact zone is situated to the other edge of the slot. This ferromagnetic earth is advantageously constituted by a screw passing lengthwise through the slot and having a head dimensioned in such a way as to cause the required effect.

The first contact means is preferably stationary with respect to a case of the apparatus and the second contact means is movable with respect to this case. However, this may also be a movable contact means. According to a particular embodiment, this may be a bridging movable contact establishing the contact between two stationary contact means, in which case the connection zone of the first contact means is itself a contact zone with one of the stationary contact means.

The apparatus preferably comprises in addition an arc extinguishing device with separators, arranged in such a way that in the open position of the contact means, it is located in a half-space bounded by a plane perpendicular to the longitudinal axis of the first contact means and situated between the two ends of the first contact means, this half-space not containing the first end of the first contact means. According to one embodiment, the separators are U-shaped, the center part of the separators having an edge situated close to the edge of the slot opposite from the contact zone of the first contact means.

BRIEF DESCRIPTION OF THE DRAWINGS

Other advantages and features of the invention will become more clearly apparent from the following description of different embodiments of the invention, given as non-restrictive examples only and represented in the accompanying drawings in which.

DETAILED DESCRIPTION OF THE PREFERRED EMBODIMENT

Figure 1:
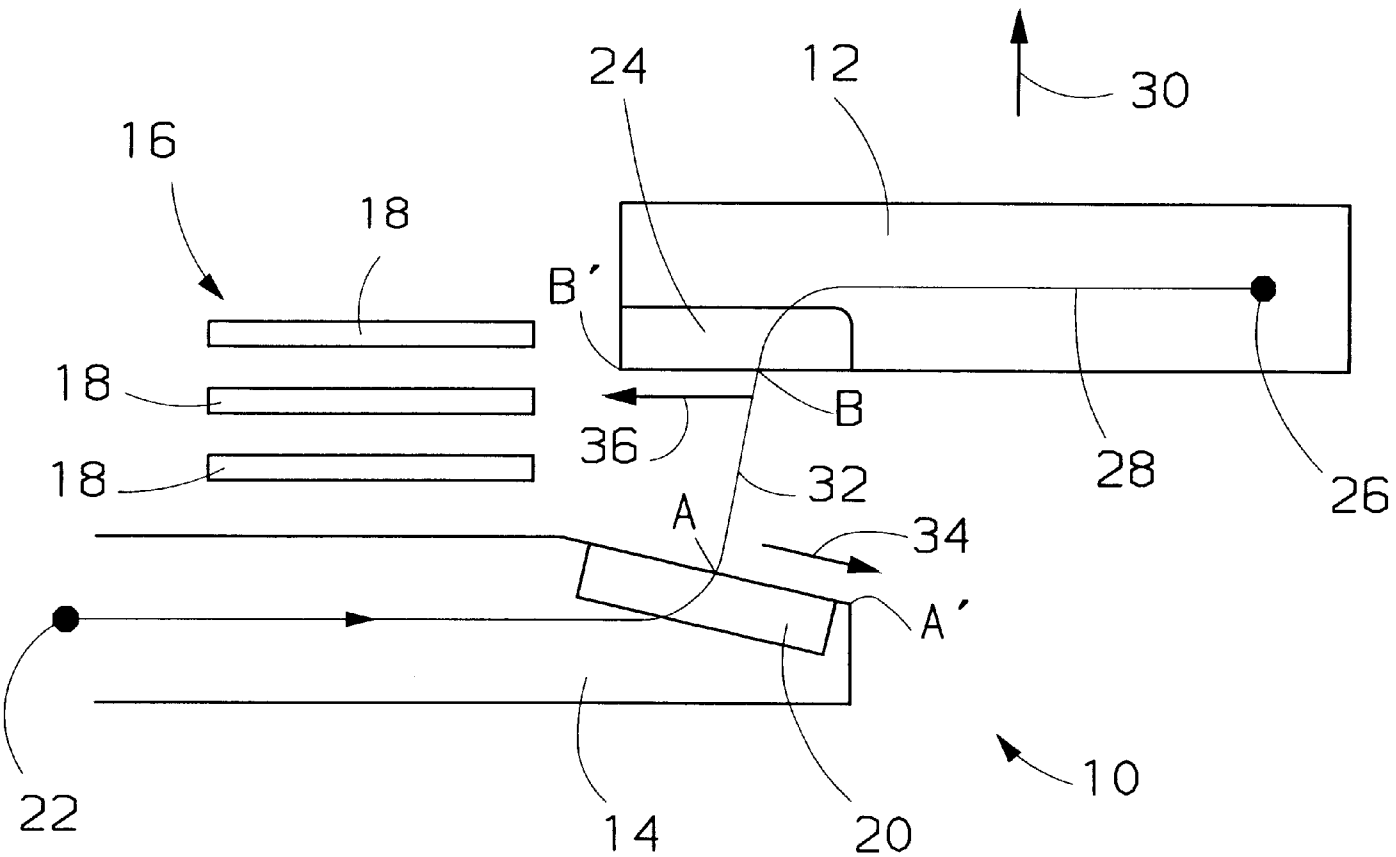
FIG. 1, discussed above, represents a pole of a switch of the state of the technique.
Figure 2:
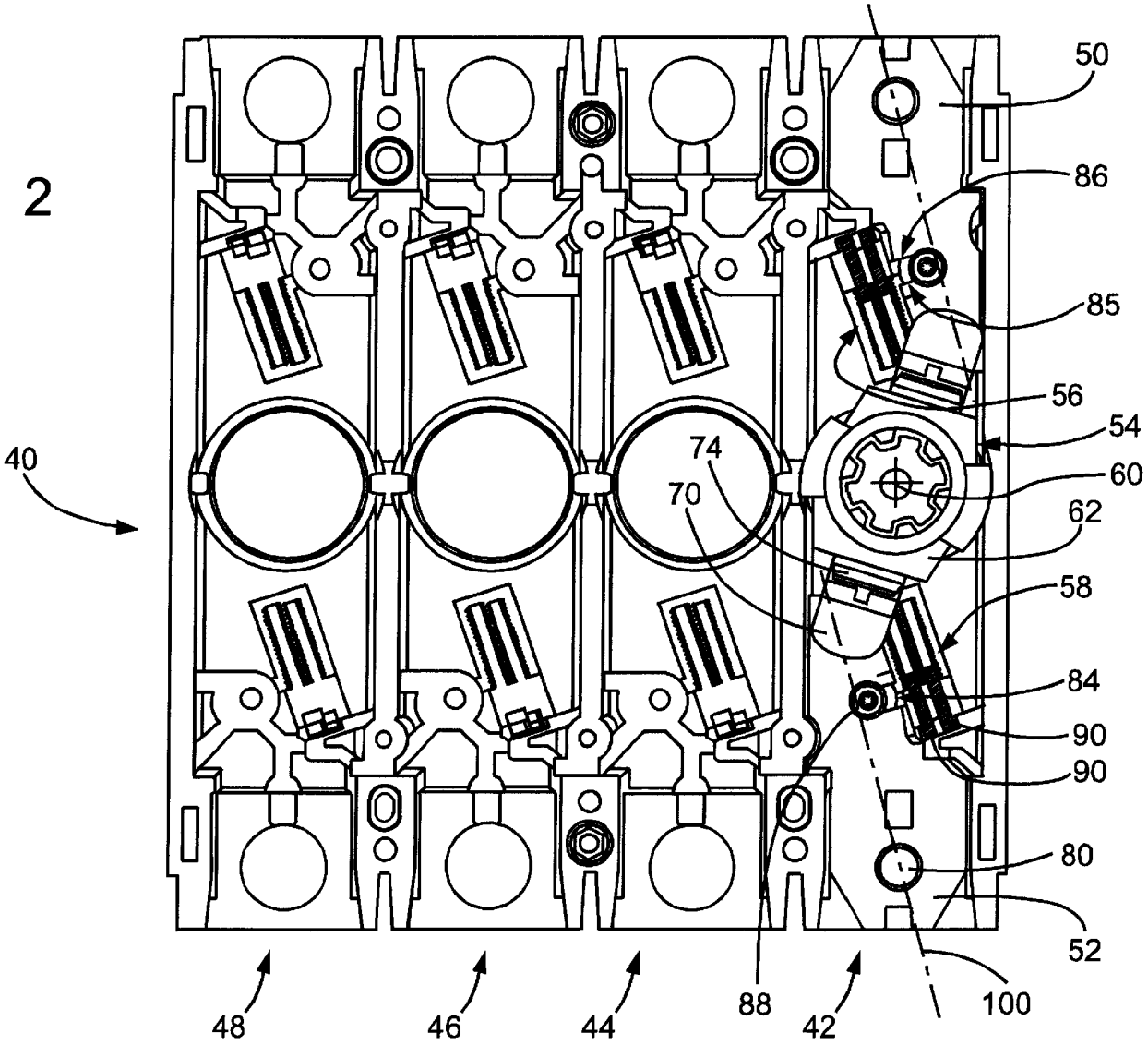
FIG. 2 represents a top view of a switch according to a first embodiment of the invention, showing contact means and extinguishing chambers.
Figure 3:
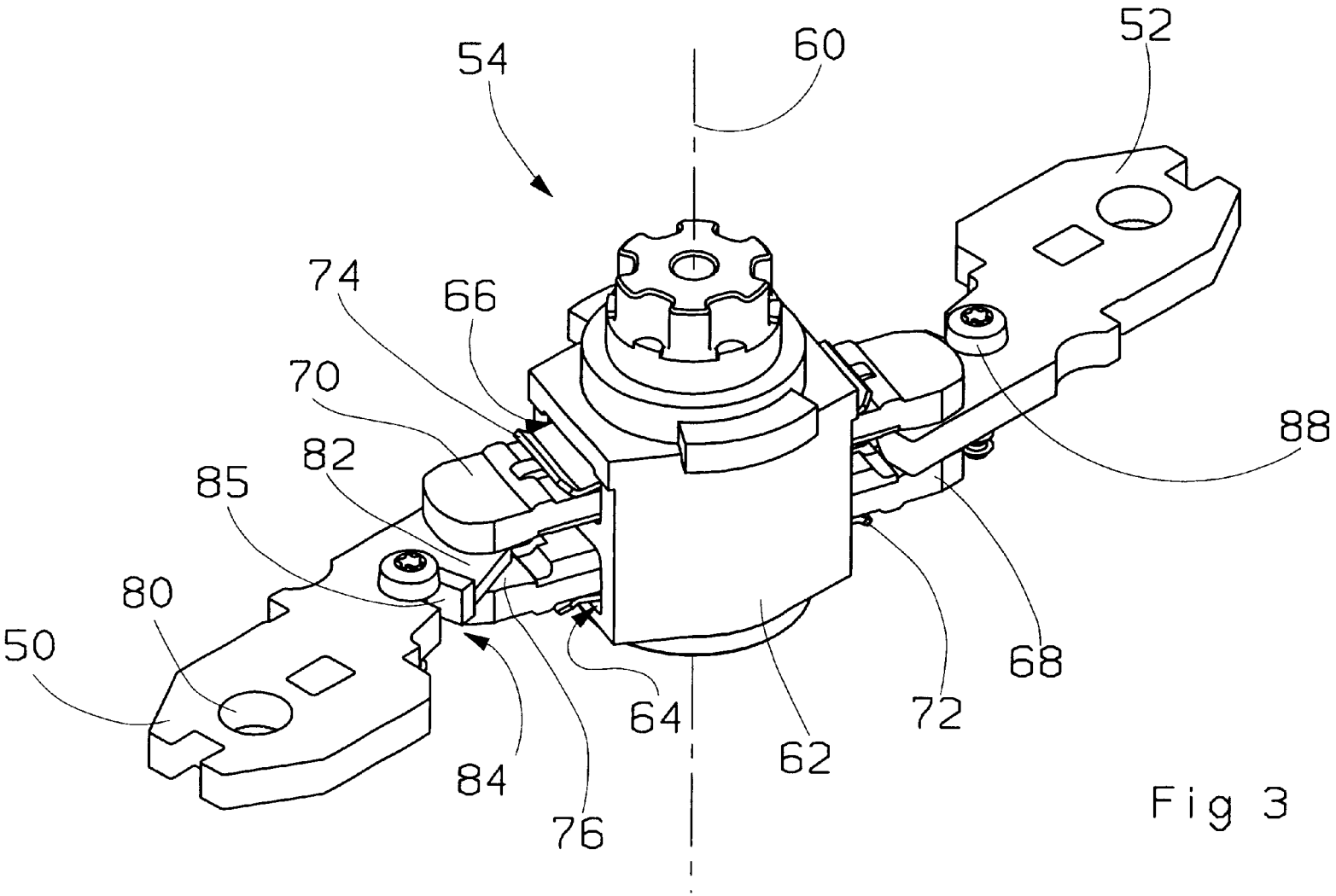
FIG. 3 represents a perspective view of the contact means of the switch according to the first embodiment of the invention.
Figure 4:
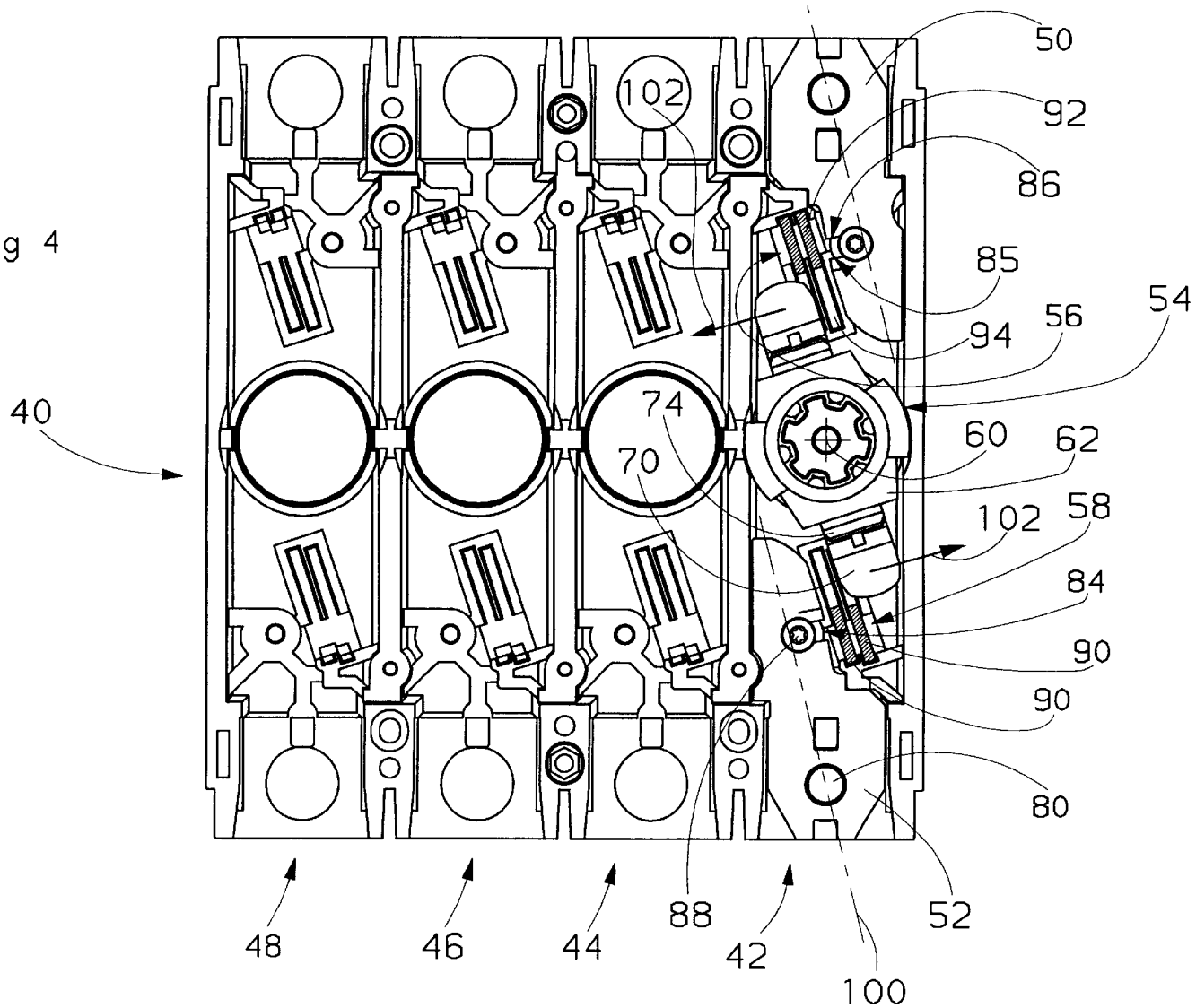
FIG. 4 represents a pole of the switch according to the first embodiment of the invention, in the open position.

With reference to FIGS. 2 to 4, a four-pole switch 40 comprises four poles 42, 44, 46, 48 arranged side by side in compartments of a case made of molded synthetic material. The poles are all identical and each comprise a line-side fixed connection strip 50 connected to the line-side circuit and constituting a stationary contact means, a load-side fixed connection strip 52 connected to the load-side electrical circuit and constituting a stationary contact means, a bridging movable contact means 54, and two arc extinguishing chambers 56, 58. The movable contact means 54 is mounted rotating around a spindle 60 perpendicular to the plane of FIG. 2. The construction of the poles is symmetrical with respect to the spindle 60, so that the description of a half-pole will be sufficient to describe the complete pole.

The movable contact means of the different poles are all mechanically connected, by a common kinematic connection system, to an operating mechanism known in itself and not represented, so that operation of a single operating means of the operating mechanism enables simultaneous rotation of the movable contact means of the four poles of the switch.

The bridging movable contact means 54, which can be seen in detail in FIG. 3, comprise in conventional manner an operating mechanism, or rotary support 62 made of plastic material comprising two cavities 64, 66 passing radially therethrough from one side to the other and each enabling insertion of a metallic bridging finger 68, 70 and a flexible blade 72, 74 constituting a return spring. Each finger 68, 70 is capable of a slight translation parallel to the rotation spindle 60 of the support 62 and of a slight rocking pivoting with respect to the support 62, around an imaginary geometric axis appreciably perpendicular to the axis of rotation of the support and to the fingers, the spring blade 72, 74 constantly urging the two fingers 68, 70 towards one another to a rest position.

The two fingers are identical. Each finger is of symmetrical construction with respect to a mid-plane containing the spindle 60. At each of its ends, the finger comprises a convex contact zone 76 arranged facing the other finger.

Each stationary contact means is formed by a long, slender metallic part which comprises a bore 80 on the same side as one of its ends, designed for connection to the electrical circuit and materializing an electrical connection zone, and a contact zone 82 in the form of a knife-blade on the same side as its other end. A slot 84 partially separates the contact zone 82 from the piece of the part comprising the connection 80. The thickness of residual material of the contact means 50 opposite the slot 84 is sufficient to allow flow of a current of 10 $I_n$ for 20 seconds without destructive overheating. In this embodiment, the depth of the slot 84 is about a half of the thickness of the contact means. The slot presents a flank 85 on the same side as the contact zone 82 is situated, a flank 86 (visible in FIG. 2) situated on the same side as the connection zone, and an opening directed towards the zone where the electrical arc generated by opening is designed to develop, i.e. towards the arc extinguishing chamber 56.

A screw 88 constituting a metallic mass is inserted in the bottom of the slot.

The contact zone 82 of the stationary contact means 50 extends on the two lateral faces of the stationary contact means and constitutes the zone designed to come into contact with the corresponding contact zones 76 of the fingers 68, 70 of the movable contact means. Each end of the pair of fingers 68, 70 forms a grip which, in the closed position in FIG. 3, grips the contact zone 82 in the form of a knife-blade of the corresponding stationary contact means.

The arc extinguishing chambers 56, 58, which can be seen in FIG. 2, are similar and each comprise in conventional manner two separators 90 arranged appreciably parallel to the corresponding stationary contact means. The separators 90 are U-shaped enabling the corresponding end of the fingers 68, 70 of the movable contact means to pass, with a center part 92 and two lateral branches 94.

Opening of the mechanism will be described with reference to separation between the movable contact means 54 and the stationary contact means 50, it naturally being understood that separation between the movable contact means 54 and the other stationary contact means 52 takes place at the same time. This opening is performed in the following manner.

The closed position enables a longitudinal axis 100 of the stationary contact means to be defined, passing through the connection zone 80 and the part of the contact zone 82 constituting the effective contact surface between the stationary contact means 50 and the fingers 68, 70. This axis in a certain manner constitutes a longitudinal middle line of the stationary contact means. The current lines in the material constituting the stationary contact means follow this axis 100 approximately going directly from the connection zone to the effective contact surface. The slot 84 does not then constitute a significant obstacle for the current lines.

When the opening mechanism causes rotation of the spindle 62 in the opening direction 102 to the open position of FIG. 4, the fingers 68, 70 slide along the contact zone in the form of a knife-blade 82, being moved towards one another by the action of the two spring blades 72, 74. The effective contact surface between the knife-blade 82 and each finger moves quickly towards the rear of the knife-blade 82, before the fingers 68, 70 are totally separated from the stationary contact means 50.

The spindle 60 is distant from the axis 100, so that the initial speed vector of the contact zone of the movable contact means when opening of the pole takes place has a high component along the longitudinal axis 100. However, at the moment when separation of the contacts takes place, the movable contact means has already covered a travel of about 150, and the speed vector of the contact zone of the movable contact at the moment when separation of the contact zones takes place has a predominant component in the direction 102 perpendicular to the longitudinal axis 100, the residual component parallel to the axis 100 being smaller. Consequently, the path traced by the contact means, as the rotary support moves from the closed to open position, forms an angle with the longitudinal axis that is more than 45° at a locus of the path where separation of the contacts takes place.

Between the beginning of the opening movement and the time when separation of the contact means takes place, the current lines in the material of the stationary contact means are directed in such a way as to follow the movement of the effective contact surface. They curve and take an L shape to go round the slot, and are directed approximately parallel to the flank of the slot situated on the same side as the contact zone 82.

An electrical arc arises between the last points in contact of the stationary contact means 50 and of the movable contact means 54. At this moment, the current lines in the material of the stationary contact means 50 are relatively parallel to the flank 85 of the slot 84 situated on the same side as the contact zone 82. This effect is all the more accentuated the deeper the slot 84 and the closer the last contact point is to the edge of the slot 84.

Due to this orientation of the current lines, the foot of the electrical arc tends not to move away from the free end of the stationary contact means 50. Migration of the head of the arc towards the end of the fingers 68, 70 of the movable contact means 54, in conjunction with the ionization generated by the arc, enables stabilization of the electrical arc near to the edge of the flank 85 of the slot 84, followed by migration of the arc into the extinguishing chamber.

This arc jump is fostered by the magnetic effect due to the presence of a ferromagnetic ground formed by the screw whose head is calibrated accordingly.

From a dimensional point of view, compliance with certain empirical rules seems to foster optimum operation of the switch gear apparatus. If what is sought is simply fast stabilization of the foot of the arc near to the arc extinguishing chamber, on the edge of the flank 85 of the slot 84, the slot can advantageously be placed underneath the extinguishing chamber, as illustrated by FIGS. 2 to 4, facing the center part 92 of the separators 90, relatively far from the free end of the movable contact means 54.

Figure 5:
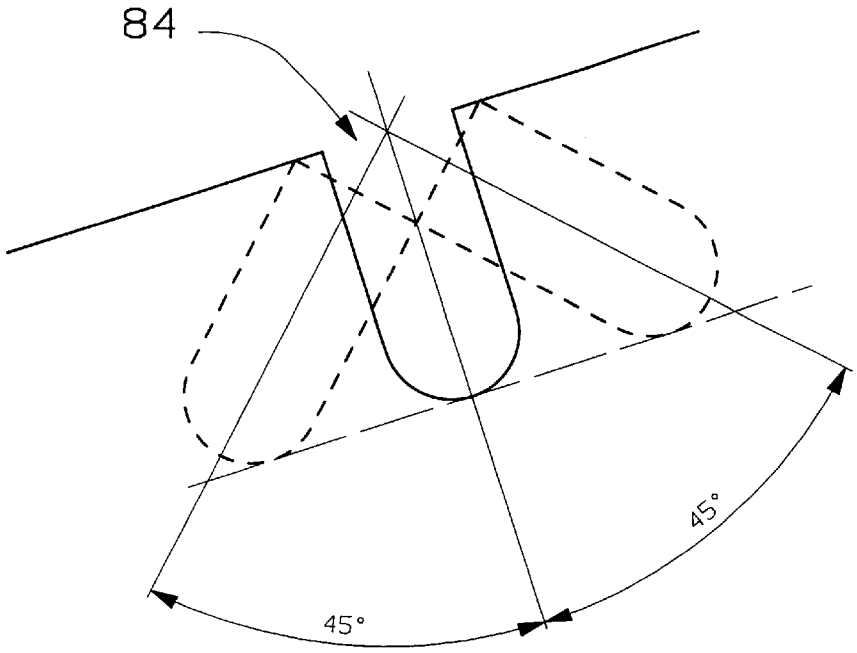
FIG. 5 represents a pole of a switch according to a second embodiment of the invention.
Figure 6:
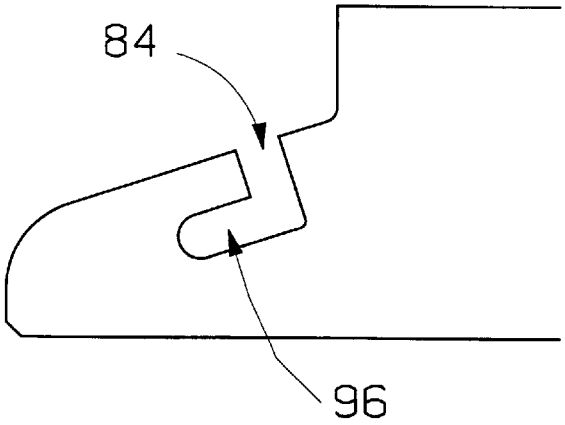
FIG. 6 represents a pole of a switch according to a third embodiment of the invention.

The shape of the slot can vary considerably according to the configuration of the contact means. FIG. 5 shows various possible orientations of the slot. FIG. 6 represents a slot 84 extended towards the inside of the stationary contact means by a longitudinally oriented cavity 96.

Figure 7:
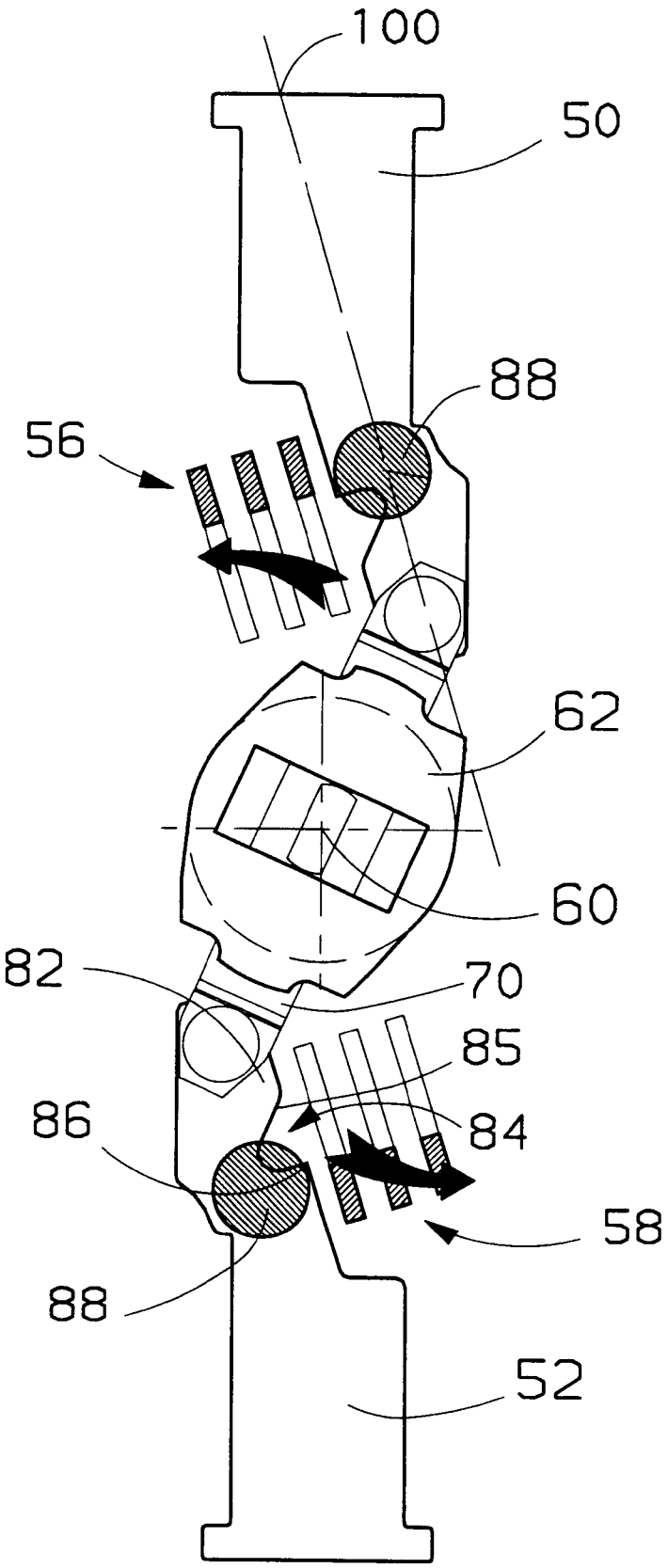
FIG. 7 represents a pole of a switch according to a fourth embodiment of the invention.

If it is desired to move the foot of the arc further away from the contact zone and to prevent any risk of the foot of the arc returning towards the contact zone, it is useful to foster an arc jump from the edge of the flank 85 to the edge of the flank 86 of the slot 84. To do this, the free end of the fingers 68, 70 of the movable contact means 54 is advantageously situated, at the beginning of opening, at the height of the edge of the flank 85 of the slot 84 situated on the same side as the contact zone 82. The edge of the center part 92 of the separators 90 facing the movable contact means 54 is advantageously situated at the height of the other edge of the slot. Such an arrangement is represented in FIG. 7 which shows a tapered slot 84 whose flanks 85, 86 are not parallel. The edge situated on the side opposite the contact zone 82 presents a sharp edge designed to accommodate the foot of the arc after the slot jump. A broad-headed screw or a ferromagnetic mass 88 is placed in an independent bore of the slot, in a position designed to maximize the magnetic effect. The current lines in fact tend to run round the ferromagnetic mass, either running under the slot or choosing the shortest path, to the sharp edge of the slot opposite the contact zones. As soon as an arc flashover takes place on the sharp edge, the ferromagnetic mass prevents any restriking on the side where the contact zone of the stationary contact means is located.

The invention is naturally not limited to the embodiments described above. In particular, it should be noted that the effect of the slot is not linked to the kinematic system of the movable contacts —the teaching of the invention is applicable both to contact means movable in translation and to contact means movable in rotation. The fact that, in the first embodiment of the invention, the movable contact means is bridging, is in no way limiting.

The presence of a metallic earth is not always necessary, and the screw may be omitted if desired.

The contact means are not necessarily of the knife-blade and grip type, and the invention also applies to other types of contact means.

The invention is applicable not only to switches but also to other electrical switchgear apparatuses, in particular to circuit breakers.

In the above embodiments, the stationary contact means bearing the slot is obtained by cutting out from a copper plate. Alternatively it is possible to manufacture the part by matrixing, in which case the slot is obtained by material extrusion. This process enables the cross-section of the copper part facing the slot, in the direction perpendicular to the plane of FIG. 2, to be increased, the side faces of the part then taking a convex aspect. Such a shape limits the heat rise by Joule effect.

What is claimed is:

1. An electrical switchgear apparatus comprising:

at least one pair of first and second separable contact means, the first contact means having a longitudinal axis, a first end with a contact zone, a second end with an electrical connection zone, and a slot in the first contact means between the contact and connection zones, the slot being close to the contact zone and opening toward the second separable contact means, the slot having a contact zone side edge closer to the contact zone than a distal-side edge, and the second contact means having a contact zone, and being positioned so that the contact zone of the second contact means can contact the contact zone of the first means, thereby achieving a closed position and when separated an open position;

an operating mechanism to move the at least one pair of contact means between the closed and open positions, along a path traced by the second contact means as the mechanism moves from the closed to open position, the path forming an angle with the longitudinal axis of the first contact means, in the direction of the second contact means, that is more than 45° at a locus of the path where separation of the contact means takes place.

2. The apparatus of claim 1, wherein the slot extends ⅓ to ⅔ of the distance across the first contact means measured along an axis perpendicular to the longitudinal axis of the first contact means.

3. The apparatus of claim 1, wherein the slot extends the depth of the contact means at an angle, the angle selected from angles ranging 45° in either direction from an axis perpendicular to the longitudinal axis of the first contact means.

4. The apparatus of claim 1, wherein the slot is wider than 1 mm.

5. The apparatus of claim 1, wherein the width of the slot allows an electrical arc, extending between the contact zones in the open position, to pass from one edge of the slot to the other.

6. The apparatus of claim 6, wherein the slot extends to meet a cavity along the longitudinal axis of the first contact means.

7. The apparatus of claim 1, comprising a ferromagnetic mass near enough to the slot to foster passage of an electrical arc extending between the contact zones, from the contact zone side edge of the slot to the distal side edge of the slot.

8. The apparatus of claim 1, wherein the first contact means is stationary with respect to a case for housing the first and second contact means, and the second contact means moves with respect to the case.

9. The apparatus of claim 1, further comprising: an arc extinguishing device with separators, the arc extinguishing device, in the open position of the contact means, is in a half-space bounded by a plane perpendicular to the longitudinal axis of the first contact means and between the two ends of the first contact means, the half-space not containing the first end of the first contact means.

10. The apparatus of claim 9, wherein the separators are U-shaped, the center part of the separators having an edge close to the distal side edge of the slot.

* * * * *